United States Patent [19]

Holland et al.

[11] 4,354,687

[45] Oct. 19, 1982

[54] GAS TURBINE ENGINES

[75] Inventors: Brian C. Holland, Darley Abbey; Roy T. Hirst, Ticknall; Roger J. M. Sills; Cyril G. Moore, both of Littleover, all of England

[73] Assignee: Rolls-Royce Limited, London, England

[21] Appl. No.: 296,072

[22] Filed: Aug. 25, 1981

[30] Foreign Application Priority Data

Nov. 22, 1980 [GB] United Kingdom ..... 8037540

[51] Int. Cl.[3] ..... F16J 15/00; F02F 11/00; F04D 29/08

[52] U.S. Cl. ..... 277/26; 415/136; 415/138

[58] Field of Search ..... 415/134, 135, 136, 138; 277/26, 236

[56] References Cited

U.S. PATENT DOCUMENTS

| | | | |
|---|---|---|---|
| 2,962,256 | 11/1960 | Bishop | 415/136 |
| 3,321,179 | 5/1967 | Johnson et al. | 415/136 |
| 3,514,112 | 5/1970 | Pettengill | 277/26 |
| 3,526,407 | 9/1970 | Chattin et al. | 277/26 |
| 3,860,358 | 1/1975 | Cauicchi et al. | 277/26 |
| 4,184,689 | 1/1980 | Brodell et al. | 277/26 |

*Primary Examiner*—Robert I. Smith

*Attorney, Agent, or Firm*—Cushman, Darby & Cushman

[57] ABSTRACT

A gas turbine engine blade tip seal consists of a sealing ring which is controlled by means of two annular control members. The members are arranged such that one control member has a relatively rapid thermal response rate and the other control member has a relatively slow thermal response rate, the sealing ring being controlled such that a preferred tip clearance is maintained under varying engine operating conditions.

7 Claims, 2 Drawing Figures

GAS TURBINE ENGINES

This invention relates to gas turbine engines and more particularly to a sealing arrangement for sealing the blade tips of an "unshrouded" or "shrouded" type of gas turbine engine turbine rotor.

The difficulties of tip sealing unshrouded type turbine rotors has been well known for many years. This problem has become worse as the size of gas turbine engines and their working temperatures have increased. One of the main factors which has to be considered when attempting to design a satisfactory sealing arrangement is the matching of the respective diameters of the turbine rotor and casing at their working temperatures taking into account the differing coefficients of expansion of the materials used in the turbine and casing construction.

Consideration must also be given to the fact that when an engine is run up to operating speed the rotor and casing are subjected to several stages of radial growth. In the first instance the relatively thin rotor blades expand quickly in response to increase in temperature and centrifugal loading and to this is added the radial growth of the rotor disc due to centrifugal loading. A further stage of radial growth occurs when the relatively thick rotor disc heats up to operating temperature. During all the aforementioned phases of expansion the casing surrounding the rotor grows at a steadily decreasing rate during the overall heating up process. Therefore the tip clearance between the rotor blades and the casing must be calculated such as to tolerate all relative changes in growth of both the entire turbine rotor and the casing.

Furthermore there are other operating conditions for which the tip clearances must be designed to tolerate, for example when the engine speed is reduced or alternatively the engine is shut down completely. In this situation the turbine casing will cool down and contract extremely quickly whilst the rotor is still relatively hot and still subjected to the centrifugal effect.

The object of the present invention is to provide a tip seal which includes means such that the turbine tip clearance can be controlled or maintained at an optimum under most engine operating conditions.

According to the present invention a gas turbine engine turbine tip sealing device comprises an annular sealing ring, a first annular control member having means cooperating with the annular sealing ring, said annular control member having a relatively rapid response rate such that it expands or contracts quickly in accordance with a temperature variation, and a second annular control member having a relatively slow response rate such that it expands or contracts relatively slowly in accordance with a variation in temperature, the arrangement being such that upon an increase in temperature occuring on the device the first annular control member expands relatively rapidly and by virtue of its cooperating means also expands the annular sealing ring, however upon the first annular control member reaching a particular diameter it contacts and is restrained from further expansion by the second annular control member such that the sealing ring is then expanded relatively slowly in accordance with the rate of expansion of the second annular control member, and upon a decrease in temperature occuring upon the device the annular sealing ring initially contracts relatively slowly in accordance with the second annular control member in a first phase of contraction, and then relatively quickly in accordance with the first annular control member in a second phase of contraction.

According to a further aspect of the present invention a gas turbine engine turbine tip sealing device may comprise an annular sealing ring, a first annular control member having means cooperating with the annular sealing ring, said annular control member having a relatively rapid response rate such that it expands or contracts quickly in accordance with a temperature variation, and a second annular control member having means cooperating with the first annular control member, the second annular control member having a relatively slow response rate such that it expands or contracts relatively slowly in accordance with a variation in temperature, the arrangement being such that upon an increase in temperature occuring on the device the first annular control member expands relatively rapidly and by virtue of its cooperating means also expands the annular sealing ring, however upon the first annular control member reaching a particular diameter it contacts and is restrained from further expansion by the second annular control member such that the sealing ring is then expanded relatively slowly in accordance with the rate of expansion of the second annular control member, and upon a decrease in temperature occuring upon the device the annular sealing ring initially contracts relatively slowly in accordance with the second annular control member in a first phase of contraction, and then relatively quickly in accordance with the first annular control member in a second phase of contraction until the first annular control member is restrained from further contraction by the second annular control member such that the annular sealing ring will then contract in accordance with the second annular control member in a third phase of contraction.

The annular sealing ring may comprise a plurality of segmented members adapted to be slidable with respect to each other, or alternatively may be a continuous ring of resilient material.

The first annular control member may consist of a relatively thin section cylindrical member having a relatively small mass and the second annular control member may comprise a relatively thick section cylinder or alternatively may consist of a portion of the engine casing having a relatively large mass.

Preferably the cooperating means provided upon the first annular control member comprises an axially extending recess in which a portion of the annular sealing ring is located.

Furthermore the cooperating means provided upon the second annular control member comprises an axially extending spigot which is located with a recess located within the first annular control member.

For better understanding of the invention an embodiment thereof will be more particularly described by way of example only and with reference to the accompanying drawings in which.

Figure 1:
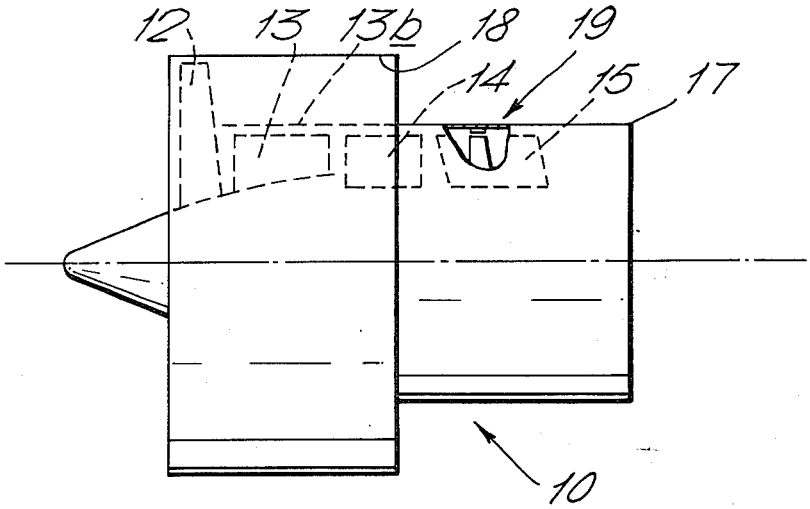
FIG. 1 shows a diagramatic side view of a ducted fan type gas turbine engine including a broken away casing portion disclosing a diagrammatic embodiment of the present invention.

Referring to the drawings a gas turbine engine shown generally at 10 includes in flow series a fan 12, a compressor section 13, a combustion section 14, a turbine section 15, the engine terminating in an exhaust nozzle 17. The fan is rotatably mounted within a fan duct 18 which is disposed radially outwardly and coaxial with the compressor section casing 13*b* shown generally in the direction of arrow 19 is a diagrammatic embodiment of a turbine tip sealing device made in accordance with the present invention.

Figure 2:
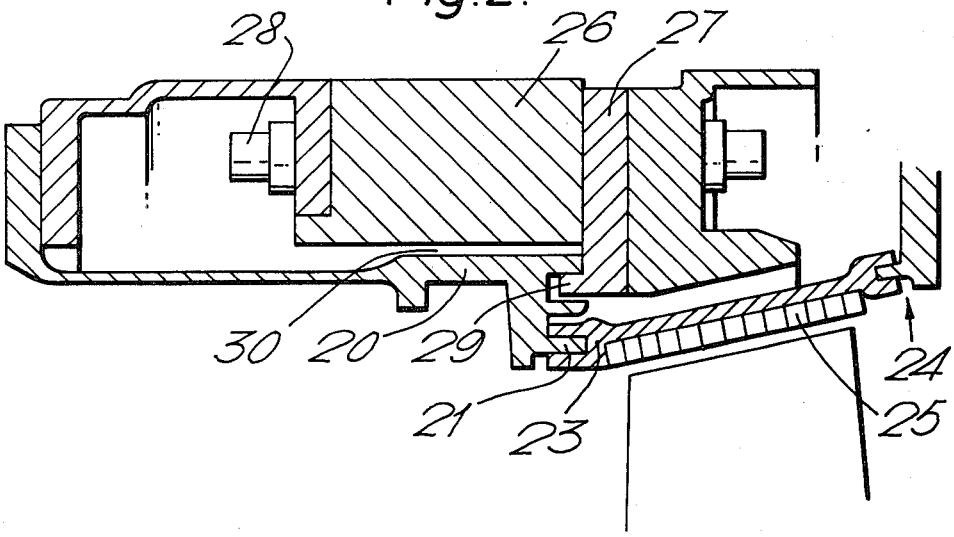
FIG. 2 shows an enlarged cross-sectional view in greater detail of the embodiment shown diagrammatically at FIG. 1.

FIG. 2 of the drawings shows an enlarged cross-sectional view of the turbine tip seal device shown generally at arrow 19 in FIG. 1. The device includes a first annular control member 20 which is of relatively thin cross-section such that it has a relatively small mass. The first annular control member 20 also includes an axially extending spigot 21 which is adapted to lie within a groove which is located within the upstream face of a sealing ring 23. The downstream end of the sealing ring is located on engine fixed structure 24 by means of a cooperating spigot and groove arrangement shown generally at 24. The sealing ring 23 preferably consists of a plurality of segments which are slidably located with respect to each other. Alternatively the sealing ring 23 may consist of a resilient material, however both types of sealing ring may include an abradable lining 25 such as for example honeycomb.

Arranged radially outwardly of the first annular control member 20 is located a second annular control member 26 which has a relatively thick cross-section and hence a relatively large mass as compared with the first annular control member. For convenience the second annular control member 26 in this instance takes the form of a separate ring, however in certain circumstances there may be advantages in making it form a part of the engine casing.

A flange portion 27 is secured to the second annular control member 26 by means of a plurality of axially extending bolts one of which is shown at 28. The flange portion 27 includes an axially extending spigot 29 which is located within a further groove located within the first annular control member 20 such that during certain modes of the engine's operation the movement of one annular control member is controlled by the movement of the other.

When the gas turbine engine is first started from the cold condition the turbine blades will expand quickly due to increase in temperature and also because of the centrifugal forces acting upon them. Therefore the sealing ring 23 must have the ability to increase in diameter quickly to ensure that a clearance is maintained between the turbine blade tips and the abradable material layer 25. This is achieved by means of the first annular control member 20 which by virtue of its relatively thin cross-section and low mass reacts quickly in accordance with a temperature variation. In this case the temperature increases quickly therefore the first annular control member 20 will expand and by virtue of the portion 21 cooperating with the seal ring 25 will move the seal ring radially outwards.

However after an initial temperature increase and centrifugal force acting upon the blades in a first rapid growth phase their rate of radial growth will slow down to a second phase of growth. Therefore to ensure that the first control member 20 does not continue to expand too quickly and so displace the sealing ring to produce an unacceptably large seal clearance the internal diameter of the second control member 26 is sized such that the clearance shown at 30 between the two members reduces until the first control member is restrained from further rapid expansion by the second control member 26.

The turbine rotor and blade however will continue to expand at a slower rate of expansion or second phase of expansion. In this phase the relatively large mass of the turbine rotor steadily increases in temperature to that of the engine operating temperature. This phase of thermal growth is therefore matched by the second control member 26 which has a relatively larger cross-sectional area and mass than the first control member 20 and this exerts a controlling influence upon it.

During deceleration of the engine in the first instance very little reduction in turbine diameter will occur as, although the temperature of the gas stream passing through the turbine will reduce quickly, this will only at first effect the turbine blades which will contract relatively quickly, however they will still be subjected to centrifugal forces due to the continuing rotation of the turbine; thence the rate of initial contraction of the turbine will be relatively small.

The temperature of the first annular control member will also be reduced relatively quickly due to its thin cross-section however it will not immediately commence reducing in diameter as it is in a state of compression due to its engagement with the second control ring 26.

The rate of contraction of the sealing ring 23 will therefore firstly be controlled by the rate of contraction of the second control member 26 during its first phase of contraction.

As the temperature of the turbine rotor and its rotational speed continue to fall the speed of contraction of the turbine diameter will increase to a second phase due to the combined action of the reduction of centrifugal effect and temperature. In this second phase of contraction the first control member 20 will have contracted sufficiently to no longer be effected by the second control member 26. The rate of contraction of the sealing ring 23 will therefore be controlled by the relatively rapid rate of contraction of the first control member 20.

The turbine will then finally enter a third phase of contraction during its deceleration, in this phase the contraction is mainly due to the relatively slow cooling large mass of the turbine rotor. To maintain an adequate blade tip clearance therefore the first control member 20 is restrained from further rapid contraction by means of the spigot provided upon the member 27 which is rigidly secured to the second control member 26. Any further contraction of the sealing ring 23 will therefore be controlled by the second control member which will contract relatively slowly by virtue of its relatively large mass.

It will be appreciated that by controlling either the relative masses of the two control members 20 and 26 or by choosing materials having different thermal coefficients of expansion or further alternatively by controlling the temperature of the environment in which the respective control members are located their relative rates of expansion and contraction or the speed at which they respond can be adjusted such as to ensure that the sealing ring may be varied in diameter to maintain an acceptable turbine tip clearance under all engine operating conditions.

Furthermore it will also be understood that although the more particularly described embodiment of the present invention includes cooperating means comprising the spigot 29 between the two control members 20 and 26, this feature under certain circumstances need not in fact be essential to the effective operation of the sealing device. It is believed that by suitable choice of materials for the control members or possibly by carefully governing the temperature of the environment in which they are located, their respective rates of expansion and contraction can be matched such as to obviate the necessity for providing the cooperating means consisting of spigot 29.

We claim:

1. A gas turbine engine turbine tip sealing device comprises an annular sealing ring, a first annular control member having means co-operating with the annular sealing ring, said annular control member having relatively rapid response rate such that it expands or contracts quickly in accordance with a temperature variation, and a second annular control member having a relatively slow response rate such that it expands or contracts relatively slowly in accordance with variation in temperature the arrangement being such that upon an increase in temperature occurring on the device the first annular control member expands relatively rapidly and by virtue of its co-operating means also expands the annular sealing ring and wherein the improvement comprises in that when the first annular control member reaches a particular diameter it contracts and is restrained from further expansion by the second annular control member such that the sealing ring is then expanded relatively slowly in accordance with the rate of expansion of the second annular control member, and upon a decrease in temperature occurring upon the device the annular sealing ring initially contracts relatively slowly in accordance with the second annular control member in a first phase of contraction and then relatively quickly in accordance with the first annular control member in a second phase of contraction.

2. A gas turbine engine turbine tip sealing device as claimed in claim 1 which comprises an annular sealing ring, a first annular control member having means co-operating with the annular sealing ring, said annular control member having a relatively rapid response rate such that it expands or contracts quickly in accordance with a temperature variation, and a second annular control member having means co-operating with the first annular control member, the second annular control member having a relatively slow response rate such that it expands or contracts relatively slowly in accordance with a variation in temperature, the arrangement being such that upon an increase in temperature occuring on the device the first annular control member expands relatively rapidly and by virtue of its co-operating means also expands the annular sealing ring and wherein the improvement comprises upon the first annular control member reaching a particular diameter it contacts and is restrained from further expansion by the second annular control member such that the sealing ring is then expanded relatively slowly in accordance with the rate of expansion of the second annular control member, and upon a decrease in temperature occuring upon the device the annular sealing ring initially contracts relatively slowly in accordance with the second annular control member in a first phase of contraction and then relatively quickly in accordance with the first annular control member in a second phase of contraction until the first annular control member is restrained from further contraction by the second annular control member such that the annular sealing ring will then contract in accordance with the second annular control member in a third phase of contraction.

3. A gas turbine engine turbine tip sealing device as claimed in claim 1 which the sealing ring comprises a plurality of segmented members adapted to be slidable with respect to each other.

4. A gas turbine engine turbine tip sealing device as claimed in claim 1 in which the annular sealing ring comprises a continuous ring of resilient material.

5. A gas turbine engine turbine tip sealing device as claimed in claim 1 in which the first annular control member consists of a relatively thin section cylindrical member having a relatively small mass and the second annular control member may comprise a relatively thick section cylindrical member or alternatively may consist of a portion of the gas turbine engine casing having a relatively large mass.

6. A gas turbine engine turbine tip sealing device as claimed in claim 1 in which the co-operating means provided upon the first annular control member comprises an axially extending recess in which a portion of the annular sealing ring is located.

7. A gas turbine engine turbine tip sealing device as claimed in claim 1 in which the co-operating means provided upon the second annular control member comprises an axially extending spigot which is located within a recess provided within the first annular control member.

* * * * *